US009592612B2

(12) United States Patent
Koenig

(10) Patent No.: US 9,592,612 B2
(45) Date of Patent: Mar. 14, 2017

(54) SPLIT SPRING LOCKING FEATURE FOR A FOLDING TOOL

(75) Inventor: Tom D. Koenig, Lakewood, CO (US)

(73) Assignee: Spyderco, Inc., Golden, CO (US)

( * ) Notice: Subject to any disclaimer, the term of this patent is extended or adjusted under 35 U.S.C. 154(b) by 379 days.

(21) Appl. No.: 13/474,396

(22) Filed: May 17, 2012

(65) Prior Publication Data

US 2013/0305541 A1 Nov. 21, 2013

(51) Int. Cl.
*B26B 1/04* (2006.01)
*B26B 1/06* (2006.01)

(52) U.S. Cl.
CPC ..... *B26B 1/04* (2013.01); *B26B 1/044* (2013.01); *B26B 1/06* (2013.01)

(58) Field of Classification Search
CPC B26B 1/04; B26B 1/042; B26B 1/044; B26B 1/06
USPC ..... 30/155, 157, 160, 161
See application file for complete search history.

(56) References Cited

U.S. PATENT DOCUMENTS 462,141 A * 10/1891 Kruschke ..... B26B 1/046 30/159
492,084 A 2/1893 Brigham
552,077 A 12/1895 Wagner
557,818 A 4/1896 Hotchkiss
589,737 A 9/1897 Miller
589,738 A 9/1897 Miller
600,442 A 3/1898 Nell
698,080 A 4/1902 Treas
736,525 A 8/1903 Kaufmann
749,230 A 1/1904 Severance
845,130 A 2/1907 Schrade
988,068 A * 3/1911 Beardsley et al. ..... 30/161
1,030,058 A * 6/1912 Doles ..... 30/161
1,194,503 A 8/1916 Jawoisch
1,362,142 A * 12/1920 Rohrer ..... B26B 1/042 30/161
1,614,949 A 1/1927 Finley
1,803,899 A 5/1931 Fuller
1,864,011 A 6/1932 Brown
1,994,215 A 3/1935 Gaunt
2,098,678 A * 11/1937 Schrade ..... 30/159
2,263,415 A * 11/1941 Louis et al. ..... 30/160
2,415,367 A 4/1947 Pavlovic
(Continued)

FOREIGN PATENT DOCUMENTS

CA 1130567 8/1982
CN 1106247 4/2003
(Continued)

OTHER PUBLICATIONS

English Translation of FR2906750.*
(Continued)

*Primary Examiner* — Jennifer Swinney
(74) *Attorney, Agent, or Firm* — Sheridan Ross P.C.

(57) ABSTRACT

A folding tool with improved locking features is provided. The locking feature comprises a substantially rigid member disposed between or proximal to a handle portion of the tool. The substantially rigid member comprises a bifurcated end forming at least one biased member for contacting a tang of the tool and securing the tool in at least one of a closed and an open position with additional locking features.

15 Claims, 3 Drawing Sheets

(56) References Cited

U.S. PATENT DOCUMENTS 2,461,941 A 2/1949 Sutton
2,481,309 A 9/1949 Gunnarson
D166,064 S 3/1952 Blecher
2,630,114 A 3/1953 Hart
2,889,621 A 6/1959 Bassett
3,006,443 A 10/1961 Siler
3,263,329 A 8/1966 Hennessy
D224,388 S 7/1972 Wood
D224,389 S 7/1972 Wood
3,731,961 A 5/1973 Becker
D227,071 S 6/1973 Bernadotte
3,783,509 A 1/1974 Lake
3,871,141 A 3/1975 Bonapace
D237,458 S 11/1975 Laughlin
3,930,309 A 1/1976 Collins
3,942,394 A 3/1976 Juranitch
4,040,181 A 8/1977 Johnson
4,070,011 A 1/1978 Glesser
4,083,110 A 4/1978 Goldin et al.
4,124,939 A * 11/1978 Onoue ..... 30/161
4,133,106 A 1/1979 Addis
4,170,061 A 10/1979 Henry
D256,427 S 8/1980 Lile
D256,981 S 9/1980 Sakurai
D257,056 S 9/1980 Spivey
4,231,194 A 11/1980 Glesser
D257,612 S 12/1980 Goldin et al.
4,240,201 A * 12/1980 Sawby et al. ..... 30/161
4,266,591 A 5/1981 F'Geppert
4,272,887 A 6/1981 Poehlmann
4,274,200 A 6/1981 Coder
4,347,665 A 9/1982 Glesser
4,356,631 A 11/1982 Guth
4,393,539 A 7/1983 Weissman
4,394,096 A 7/1983 Stevens
4,408,394 A 10/1983 Phelps
4,447,950 A 5/1984 Mizelle
4,451,982 A 6/1984 Collins
D275,448 S 9/1984 Ferraro
4,535,539 A * 8/1985 Friedman et al. ..... 30/161
D280,427 S 9/1985 Jones
4,604,803 A 8/1986 Sawby
4,640,058 A 2/1987 Glesser
D288,898 S 3/1987 Osterhout
4,696,129 A 9/1987 Roberts
4,697,673 A 10/1987 Omata
4,703,560 A 11/1987 Brooker
4,719,700 A 1/1988 Taylor, Jr.
4,730,393 A 3/1988 Coburn
D296,518 S 7/1988 Sadler
4,759,153 A 7/1988 Cohen
4,776,094 A 10/1988 Glesser
4,778,094 A 10/1988 Fishback
4,805,303 A 2/1989 Gibbs
4,811,486 A 3/1989 Cunningham
4,819,289 A 4/1989 Gibbs
D302,649 S 8/1989 Porsche et al.
D302,650 S 8/1989 Giordano
D302,934 S 8/1989 Finn
D303,210 S 9/1989 Thompson
D304,154 S 10/1989 Osterhout
4,901,439 A 2/1990 Boyd, Jr.
D310,014 S 8/1990 Inman
4,947,551 A 8/1990 Deisch
4,947,552 A 8/1990 Barnes
D310,621 S 9/1990 Thompson
4,974,323 A 12/1990 Cassady
4,985,998 A 1/1991 Howard
D317,037 S 5/1991 Koshiishi
5,044,079 A 9/1991 Gibbs
5,060,379 A 10/1991 Neely
5,060,890 A 10/1991 Utterback et al.
D321,820 S 11/1991 Russell
D324,899 S 3/1992 Thompson
5,093,995 A 3/1992 Jan
5,095,624 A 3/1992 Ennis
5,111,581 A 5/1992 Collins
5,131,149 A 7/1992 Thompson et al.
5,153,995 A * 10/1992 Opinel ..... 30/161
D333,081 S 2/1993 Glesser
D333,251 S 2/1993 Glesser
D333,859 S 3/1993 Meyer
D337,253 S 7/1993 Glesser
D344,006 S 2/1994 Glesser
5,293,690 A 3/1994 Cassady
D347,375 S 5/1994 Sakai
D348,599 S 7/1994 Sakai
5,325,588 A 7/1994 Rogers
D349,837 S 8/1994 Glesser
D353,988 S 1/1995 Glesser
5,379,492 A 1/1995 Glesser
D356,723 S 3/1995 Sakai
5,400,509 A 3/1995 Collins
5,425,175 A 6/1995 Rogers
D363,871 S 11/1995 Coggins
D365,266 S 12/1995 Hasegawa
D366,408 S 1/1996 Sessions et al.
D367,599 S 3/1996 Sakai
5,495,673 A 3/1996 Gardiner et al.
5,495,674 A 3/1996 Taylor, Jr.
5,502,895 A 4/1996 Lemaire
5,511,310 A 4/1996 Sessions et al.
5,515,610 A 5/1996 Levin et al.
5,537,750 A * 7/1996 Seber et al. ..... 30/161
5,542,139 A 8/1996 Boivin
5,546,662 A 8/1996 Seber et al.
D373,716 S 9/1996 Keys et al.
5,572,793 A 11/1996 Collins et al.
5,580,019 A 12/1996 Glesser
5,581,888 A 12/1996 Lewis
D377,443 S 1/1997 Seber et al.
5,594,966 A 1/1997 Goldman
5,596,808 A * 1/1997 Lake et al. ..... 30/161
D378,982 S 4/1997 Thompson
5,615,484 A 4/1997 Pittman
D379,294 S 5/1997 Lum
5,628,117 A 5/1997 Glesser
D379,579 S 6/1997 Pohl
D381,060 S 7/1997 Moran
D382,189 S 8/1997 Viele
D382,459 S 8/1997 Khalsa
5,661,908 A 9/1997 Chen
D384,871 S 10/1997 McWillis
D385,173 S 10/1997 McWillis
D386,664 S 11/1997 Glesser
5,685,079 A 11/1997 Brothers et al.
5,689,890 A 11/1997 Glesser
D387,966 S 12/1997 Horn
D388,150 S 12/1997 Glesser
D389,389 S 1/1998 Glesser
D389,718 S 1/1998 Wegner
5,704,129 A 1/1998 Glesser
D391,465 S 3/1998 Glesser
D392,539 S 3/1998 Balolia
5,722,168 A 3/1998 Huang
5,737,841 A 4/1998 McHenry et al.
5,755,035 A 5/1998 Weatherly
5,765,247 A * 6/1998 Seber et al. ..... 7/128
D396,657 S 8/1998 Nagai et al.
D397,017 S 8/1998 Pardue
D397,020 S 8/1998 Pardue
5,794,346 A 8/1998 Seber et al.
5,799,400 A 9/1998 Glesser
5,822,866 A 10/1998 Pardue
5,826,340 A 10/1998 Hull
D402,178 S 12/1998 Glesser
D402,524 S 12/1998 Glesser
D403,567 S 1/1999 Glesser
D404,990 S 2/1999 Zowada
D405,338 S 2/1999 Balolia
D407,002 S 3/1999 Morton et al.
5,878,500 A 3/1999 Emerson
5,887,347 A 3/1999 Gibbs
D408,706 S 4/1999 Elishewitz

(56) References Cited

U.S. PATENT DOCUMENTS

D409,070 S 5/1999 Elishewitz
D411,431 S 6/1999 Glesser
D411,790 S 7/1999 Glesser
D412,355 S 7/1999 Saetherbo
5,920,935 A 7/1999 Beck
5,953,821 A 9/1999 Mearns
5,964,036 A 10/1999 Centofante
5,983,506 A 11/1999 Glesser
D418,383 S 1/2000 Bradichansky
D421,378 S 3/2000 Glesser
D422,476 S 4/2000 McHenry et al.
D422,477 S 4/2000 Elishewitz
D422,478 S 4/2000 Elishewitz
D422,479 S 4/2000 Pardue
D422,480 S 4/2000 McHenry et al.
D422,669 S 4/2000 Elishewitz
D422,871 S 4/2000 Terzuola
D422,873 S 4/2000 McHenry et al.
D422,877 S 4/2000 Elishewitz
D425,389 S 5/2000 Elishewitz
D425,391 S 5/2000 Bradichansky
D426,132 S 6/2000 Pardue
6,088,861 A 7/2000 Sessions et al.
D428,789 S 8/2000 McHenry et al.
D429,138 S 8/2000 Glesser
6,101,722 A 8/2000 Cheng
6,101,723 A * 8/2000 Ford ..... 30/157
6,101,724 A * 8/2000 Halligan ..... 30/161
6,122,829 A 9/2000 McHenry et al.
D431,991 S 10/2000 Elishewitz
D432,386 S 10/2000 Elishewitz
6,125,543 A 10/2000 Jhones
D433,913 S 11/2000 Pardue
D434,631 S 12/2000 Lum
D435,420 S 12/2000 Ayoob
6,154,965 A 12/2000 Sakai
D436,014 S 1/2001 Glesser
6,170,104 B1 1/2001 Seber et al.
D438,442 S 3/2001 Osborne
D438,443 S 3/2001 Keating
6,205,667 B1 3/2001 Glesser
D441,827 S 5/2001 Frank
D442,460 S 5/2001 Glesser
D442,461 S 5/2001 Glesser
D442,841 S 5/2001 Balolia
6,305,085 B1 10/2001 Stallegger et al.
6,308,420 B1 10/2001 Moser
6,314,646 B1 11/2001 Schmidt
6,338,431 B1 1/2002 Onion
6,360,443 B1 3/2002 Remus
6,363,615 B1 4/2002 Moser
6,370,778 B1 4/2002 Conable
6,378,214 B1 4/2002 Onion
6,397,477 B1 6/2002 Collins
D461,387 S 8/2002 Glesser
6,427,335 B1 8/2002 Ralph
6,430,816 B2 8/2002 Neveux
6,438,848 B1 8/2002 McHenry et al.
D464,551 S 10/2002 Glesser
6,490,797 B1 * 12/2002 Lake et al. ..... 30/161
6,523,265 B2 2/2003 Eickhorn
6,553,672 B2 4/2003 Glesser et al.
D474,669 S 5/2003 Onion
6,574,869 B1 6/2003 McHenry et al.
6,591,505 B2 7/2003 Flavigny
6,618,947 B1 9/2003 Gardiner et al.
6,675,484 B2 1/2004 McHenry et al.
6,701,621 B2 3/2004 Kain et al.
6,725,545 B2 4/2004 Frank
6,732,436 B2 5/2004 Moizis
6,751,868 B2 6/2004 Glesser
D495,940 S 9/2004 Keppel et al.
6,789,323 B2 9/2004 Moizis
6,810,588 B1 11/2004 Cheng
6,836,967 B1 1/2005 Sakai
6,918,184 B2 7/2005 Glesser
D509,124 S 9/2005 Keppel et al.
6,941,661 B2 9/2005 Frazer
6,959,494 B2 11/2005 Taylor
7,032,315 B1 4/2006 Busse
D520,843 S 5/2006 Voros
7,051,441 B2 * 5/2006 Carter, III ..... 30/161
D523,317 S 6/2006 Ryan et al.
7,059,053 B2 6/2006 Sakai
7,146,736 B1 * 12/2006 Collins ..... 30/160
7,243,430 B1 7/2007 Lerch
7,249,417 B2 7/2007 Chu
D553,467 S 10/2007 Ryan
7,293,360 B2 11/2007 Steigerwalt et al.
7,305,768 B2 12/2007 Hinderer
7,305,769 B2 12/2007 McHenry et al.
7,313,866 B2 1/2008 Linn et al.
7,340,836 B2 3/2008 Whitemiller et al.
D573,864 S 7/2008 Glesser
7,406,896 B2 8/2008 Rivera
7,409,766 B2 8/2008 Steigerwalt
7,437,822 B2 10/2008 Flagg et al.
D581,240 S 11/2008 Glesser et al.
7,458,159 B2 12/2008 Galyean et al.
7,533,466 B2 5/2009 Steigerwalt
7,543,386 B2 6/2009 Sullivan
7,555,839 B2 7/2009 Koelewyn
7,562,454 B2 7/2009 Steigerwalt et al.
7,562,455 B2 7/2009 McHenry et al.
7,627,951 B2 12/2009 Glesser et al.
7,676,931 B2 3/2010 Knight et al.
7,676,932 B2 3/2010 Grice
RE41,259 E 4/2010 McHenry et al.
7,694,421 B2 4/2010 Lin
7,774,940 B2 8/2010 Frank
7,905,023 B2 3/2011 Westerfield
7,918,028 B2 * 4/2011 Steigerwalt et al. ..... 30/155
7,987,601 B2 * 8/2011 Nakamura ..... 30/161
8,042,276 B2 10/2011 Lerch et al.
8,082,671 B2 12/2011 Saegesser
8,161,653 B2 4/2012 Nenadic
8,261,633 B2 9/2012 Maxey
8,296,958 B1 10/2012 Frazer
8,402,663 B2 3/2013 McHenry et al.
8,468,701 B1 6/2013 Perez
D686,900 S 7/2013 Ohlrich
8,505,206 B2 8/2013 VanHoy
8,572,851 B2 11/2013 Duey
8,607,460 B1 * 12/2013 Lerch et al. ..... 30/155
8,646,184 B2 2/2014 Westerfield
8,745,878 B2 6/2014 Glesser et al.
8,978,253 B2 3/2015 Snyder et al.
2001/0022113 A1 9/2001 Kojima et al.
2001/0023541 A1 9/2001 Blanchard
2003/0019108 A1 1/2003 McHenry et al.
2004/0154169 A1 8/2004 McCann
2004/0244205 A1 12/2004 Linn et al.
2006/0064877 A1 3/2006 Vallotton et al.
2006/0123632 A1 6/2006 Linn et al.
2006/0168817 A1 8/2006 Kao
2006/0168819 A1 8/2006 Perreault
2006/0272158 A1 12/2006 Williams
2007/0169351 A1 * 7/2007 Steigerwalt ..... 30/155
2008/0201953 A1 8/2008 Bremer et al.
2008/0222896 A1 9/2008 Marfione et al.
2008/0289198 A1 11/2008 Kaiser et al.
2009/0056146 A1 3/2009 Duey
2009/0144986 A1 6/2009 Frazer
2009/0183374 A1 7/2009 Kao
2009/0193664 A1 8/2009 Galyean
2009/0223061 A1 9/2009 Seber et al.
2009/0271989 A1 11/2009 VanHoy
2010/0236078 A1 9/2010 Duey
2010/0299934 A1 12/2010 VanHoy
2011/0099817 A1 5/2011 Duey
2013/0125403 A1 5/2013 Westerfield
2013/0233113 A1 9/2013 Saitoh
2013/0263455 A1 10/2013 Collins et al.
2013/0283621 A1 10/2013 Snyder et al.

(56) References Cited

U.S. PATENT DOCUMENTS

| | | | |
|---|---|---|---|
| 2014/0047718 | A1 | 2/2014 | Fellows et al. |
| 2014/0115899 | A1 | 5/2014 | Frazer |
| 2014/0373364 | A1 | 12/2014 | Li |
| 2015/0128426 | A1 | 5/2015 | Sakai |

FOREIGN PATENT DOCUMENTS

| | | | | |
|---|---|---|---|---|
| CN | 1328021 | | 7/2007 | |
| CN | 1638925 | | 5/2010 | |
| CN | 101193730 | | 5/2010 | |
| CN | 101687324 | | 11/2012 | |
| CN | 103298589 | | 9/2013 | |
| DE | 3041584 | | 6/1982 | |
| DE | 3217529 | | 1/1983 | |
| DE | 3834295 | | 7/1989 | |
| DE | 20109376 | | 8/2001 | |
| DE | 69821034 | | 11/2004 | |
| EP | 1071546 | | 1/2001 | |
| EP | 2183080 | | 5/2010 | |
| EP | 2663430 | | 11/2013 | |
| FR | 829446 | A * | 6/1928 | |
| FR | 2495-986 | | 6/1982 | |
| FR | 2906750 | A1 * | 4/2008 | ..... B26B 1/042 |
| GB | 189822620 | | 0/1898 | |
| GB | 578252 | A * | 6/1946 | |
| GB | 753590 | | 7/1956 | |
| GB | 2084058 | | 4/1982 | |
| JP | S56-175905 | | 12/1981 | |
| JP | H09-108456 | | 4/1997 | |
| JP | H09-511408 | | 11/1997 | |
| WO | WO 95/11116 | | 4/1995 | |
| WO | WO 2007055049 | A1 * | 5/2007 | |
| WO | WO 2014/039254 | | 3/2014 | |
| WO | WO 2014/039255 | | 3/2014 | |
| WO | WO 2014/130333 | | 8/2014 | |
| WO | WO 2014/130905 | | 8/2014 | |

OTHER PUBLICATIONS

Official Action for U.S. Appl. No. 13/460,370, mailed Mar. 28, 2016 18 pages.
Notice of Allowance for U.S. Appl. No. 13/460,370, mailed Jul. 15, 2016 9 pages.
U.S. Appl. No. 14/542,076, filed Nov. 14, 2014, Glesser.
"Benchmade 2003 Catalog," Axis Lock, 17 pages.
"Dear Spyderco Customer" Letter from Spyderco, Inc., Nov. 1, 2006, 2 pages.
"Ironstone," Catalog of Knives and Accessories, Fall/Winter 1995-1996, cover, pp. 6-7 and 10-13.
"K.I.S.S. & P.E.C.K." website pages from www.crkt.com/kiss.html, dated Jun. 2, 2008, 3 pages.
"K.I.S.S. Knife from Columbia River Knife and Tool" website pages from http://www.shop.com/K_I_S_S_Knife_from_Columbia_River_Knife_and_Tool-33217878-p!.shtml, dated Jun. 2, 2008, 3 pages.
"Knives and Tools for Modern Man," The Edge Company, dated unknown, p. 25.
"Latest Designs from Spyderco," date unknown, pp. 1-2.
Picture of a C40 Jot Singh Khalsa CLIPIT, date unknown, 1 page.
SOG Knives, Vision, retreived from http://web.archive.org/web/20020127064214/http://www.sogknives.com/vision.htm, Jan. 27, 2002, 1 page.
SOG Knives, X-ray Vision, retrived from http://web.archive.org/web/20011208114647/http://www.sogknives.com/xrayvis.htm, Dec. 8, 2001, 1 page.
SOG Knives, Mini X-Ray Vision, retrieved from http://web.archive.org/web/20011211023306/http://www.sogknives.com/minxrvis.htm, Dec. 11, 2001, 1 page.
SOG Knives, Night Vision, retreived from http://web.archive.org/web/20011208113219/http://www.sogknives.com/nightvis.htm, Dec. 8, 2001, 1 page.
SOG Knives, Sculptura, retrieved from http://web.archive.org/web/20011211022847/http://www.sogknives.com/sculpt.htm, Dec. 11, 2001, 1 page.
"Spyderco 2001 Dealer Catalog," Spyderco, Inc., 2001, 40 pages, uploaded in 2 parts.
"Spyderco 2001," Spyderco, Inc. 2001, 2 pages.
"Spyderco 2002," Spyderco, Inc. 2002, 3 pages.
"Spyderco 2007 Dealer Pricing," Spyderco, Inc., 2007, 4 pages.
"Spyderco 2007 Product Guide," Spyderco, Inc., 2007, 74 pages, uploaded in 3 parts.
"Spyderco 'CLIPITSTM' Flip Open With One Hand," date unknown, p. 28.
"Spyderco Think About It . . . All God's Critters Have Knives," Spyderco, Inc. 1996, 26 pages.
"Spyderco Y2K Dealer Catalog," Spyderco, Inc., 2000, 36 pages, uploaded in 2 parts.
"SpyderEdge," Spyderco, Inc., 4th Quarter, 2001, pp. 1-6.
"The Bud K Catalog," Bud K Worldwide, Early Fall 2000, p. 3, front and back cover.
"To Our Valuable Distributors and Dealers," Letter from Spyderco, Inc., Nov. 1, 2006, 4 pages.
"Welcome to the World of Spyderco," Spyderco Brochure, Spyderco, Inc., 1998, 42 pages.
Office Action for U.S. Appl. No. 12/244,151 mailed Feb. 15, 2011, 7 pages.
Office Action for U.S. Appl. No. 12/244,151 mailed Nov. 8, 2011, 8 pages.
Office Action for U.S. Appl. No. 12/244,151 mailed Mar. 28, 2013, 6 pages.
Office Action for U.S. Appl. No. 12/244,151 mailed Oct. 23, 2013, 6 pages.
Notice of Allowance for U.S. Appl. No. 12/244,151 mailed Jan. 22, 2014, 5 pages.
Office Action for U.S. Appl. No. 11/759,103, mailed Jan. 12, 2009, 12 pages.
Notice of Allowance for U.S. Appl. No. 11/759,103, mailed Jul. 28, 2009, 14 pages.
Official Action for U.S. Appl. No. 13/460,370, mailed Jun. 19, 2015 14 pages.
Final Official Action for U.S. Appl. No. 13/460,370, mailed Dec. 15, 2015 18 pages.
Official Action for U.S. Appl. No. 13/460,401, mailed Apr. 24, 2014 8 pages.
Notice of Allowance for U.S. Appl. No. 13/460,401, mailed Nov. 17, 2014 7 pages.

* cited by examiner

SPLIT SPRING LOCKING FEATURE FOR A FOLDING TOOL

FIELD OF THE INVENTION

The present invention relates generally to folding tools. More specifically, the present invention relates to folding tools, including knives, with an improved locking feature comprising a biased element in communication with a folding portion of the tool for selectively securing the folding portion in at least an open position.

BACKGROUND

Common mechanisms known for securing tools and/or knives in an open or closed position include various locking features. Locking features include back locks and liner locks, for example. Known locking mechanisms secure the blade in an open or closed position until a feature of the lock is activated or released and the blade folded to a closed or open position. Inadvertent closure or opening without a locking mechanism can expose the cutting edge of the blade and the likelihood of injury to a user or bystander.

As used herein, the term "folding tool" or "folding knife" may be used interchangeably, since the locking feature can be implemented with either a folding tool or knife assembly. It will be expressly recognized that features of the present disclosure are not limited to knives, even where discussion of specific embodiments pertains to knives.

In various jurisdictions, however, mechanisms that render a knife a "locking knife" prevent or call into question the legal propriety of an individual's possession of such knives. At the same time, however, folding knives provide a broad range of conveniences and utility to users. The history of folding knives is believed to trace back thousands of years. The appeal of such tools and demand for the same is unlikely to be impacted by regulations and statutes. Accordingly, there exists a long-felt and unsolved need to provide a folding knife with blade securing features which enable a knife to conform with various laws and regulations yet still provides the desired safety, convenience, and functional advantages of a folding knife.

SUMMARY OF THE INVENTION

Accordingly, the present invention contemplates novel systems, devices, and methods for securing a folding knife in an open or closed position without the use of conventional locking features such as known back locks, liner locks, etc.

The Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

Various laws and regulations governing the production, sale and possession of folding knives forbid or limit the use of certain locking features perceived to render a knife the functional equivalent of a fixed blade knife. The production and use of a folding knife without any blade retention means, however, produces a potentially dangerous product.

Accordingly, it is an object of the present invention to provide a folding knife which does not comprise the use of conventional locking features, such as lock-back, back-lock, liner-lock, frame lock, or mid lock features yet still allows the knife to be securely held in one of an open or closed position.

It is yet another object of the present invention to provide a folding knife devoid of conventional locking means that is both efficient and economical to produce. It is a further still object of the present invention to provide such a tool that is also lightweight and user-friendly.

It is yet another object of the present invention to provide a folding knife feature devoid of conventional locking features and which provides visual, aural, or tactile feedback to a user that the knife blade is in a fully open or fully closed position.

Accordingly, in various embodiments, the present invention comprises a folding knife with a split backspring mechanism disposed between the scales. The split backspring is in communication with the tang of the blade, wherein the tang comprises a cut out feature for receiving at least a portion of the split backspring and stabilizing or securing the blade in at least an open position. Although the present drawings and claims describe a device to retain a blade in an open or extended position it should be appreciated that the same concept and novel design could be used to retain a folding knife blade in a closed position. For the purposes of the present disclosure, it should be recognized that the terms "stabilizing" or "securing" and "stable" or "secure" or "retain" or "retention" generally refer to an aspect of the present invention whereby a knife blade is placed in an open or closed position through the application of a first force, and wherein a second force is required to displace the knife blade from the open position, the second force being larger than the first force.

In one embodiment, a folding knife is provided comprising a blade rotatable about an axis. At least a portion of the blade is disposed between a pair of scales in both an open and closed position. The axis of rotation of the blade passes through a portion of a tang of the blade, the axis being generally perpendicular to the direction in which the blade extends. The tang comprises a generally arcuate portion that is convex about the axis of rotation and a notch feature for receiving securing means of the knife. Securing means, in various embodiments, comprise a biased feature for securing the blade at least in an open position (i.e. a position of use).

In various embodiments, securing or blade retention means of the present invention comprise a split backspring feature disposed between the scales of the knife. In one embodiment, the split backspring comprises a single piece of material with a forked or split distal end proximate the tang such that when the blade is rotated to an open position, a biased portion of the split backspring engages the notch feature of the tang such that the blade is held in a substantially secure position, but may be released and returned to a closed position without the use or release of conventional locking features.

In various embodiments, tools of the present invention comprise a split backspring locking feature wherein the locking feature biases the knife blade toward a closed position in at least an initial range of rotation. In one embodiment, the blade is biased toward a closed position when the blade is between a closed position corresponding to zero degrees of rotation and a second position comprising an initial degree of rotation. A tool of the present invention thus comprises a blade and a biasing element such that the blade is biased toward a closed position throughout approximately the initial 30 degrees of blade rotation (with respect to a closed position), such that the blade will return to a completely closed position when positioned between 0 and approximately 30 degrees of rotation, absent sufficient external forces.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described in detail below. Further, the summary of the invention is neither intended nor should it be construed as being representative of the full extent and scope of the present invention. The present invention is set forth in various levels of detail in the summary of the invention, as well as, in the attached drawings and the detailed description of the invention and no limitation as to the scope of the present invention is intended to either the inclusion or non-inclusion of elements, components, etc. in this summary of the invention. Additional aspects of the present invention will become more readily apparent from the detailed description, particularly when taken together with the drawings.

BRIEF DESCRIPTION OF THE DRAWINGS

Those of skill in the art will recognize that the following description is merely illustrative of the principles of the disclosure, which may be applied in various ways to provide many different alternative embodiments. This description is made for illustrating the general principles of the teachings of this disclosure invention and is not meant to limit the inventive concepts disclosed herein.

The accompanying drawings, which are incorporated in and constitute a part of the specification, illustrate embodiments of the disclosure and together with the general description of the disclosure given above and the detailed description of the drawings given below, serve to explain the principles of the disclosures.

Figure 1:
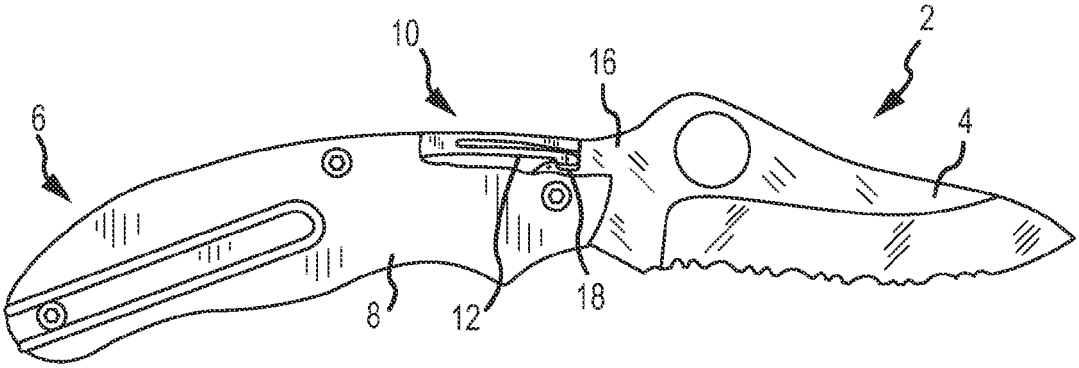
FIG. 1 is a front elevation view of a folding knife according to one embodiment of the present invention in an open position.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

To assist in the understanding of one embodiment of the present invention the following list of components and associated numbering found in the drawings is provided herein:

| # | Component |
|---|---|
| 2 | Tool |
| 4 | Blade |
| 6 | Handle |
| 8 | Scale |
| 10 | Locking feature |
| 12 | Biased member |
| 14 | Anvil |
| 16 | Tang |
| 18 | Notch |
| 20 | Shelf portion |
| 22 | Body portion |
| 26a, 26b | Apertures |
| 32 | Through hole |
| 34 | Tipping point |
| 36 | Secondary notch |
| R | Radius |

DETAILED DESCRIPTION

The present invention has significant benefits across a broad spectrum of endeavors. It is the applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment of the method that illustrates the best mode now contemplated for putting the invention into practice is described herein by, and with reference to, the annexed drawings that form a part of the specification. The exemplary method is described in detail without attempting to describe all of the various forms and modifications in which the invention might be embodied. As such, the embodiments described herein are illustrative, and as will become apparent to those skilled in the arts, can be modified in numerous ways within the scope and spirit of the invention, the invention being measured by the appended claims and not by the details of the specification.

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Referring now to FIGS. 1-5, a folding knife according to various embodiments of the present invention is shown. It should be understood that the drawings are not necessarily to scale. In certain instances, details that are not necessary for an understanding of the invention or that render other details difficult to perceive may have been omitted from these drawings. It should be understood, of course, that the invention is not limited to the particular embodiments illustrated in the drawings.

FIG. 1 is a front elevation of a folding knife according to one embodiment shown in the open position. The folding knife 2 generally comprises a blade portion 4, a handle 6 comprising at least one scale 8. The blade 4 is hingedly attached to the handle 6 such that the blade 4 may be selectively rotated between an open and closed position. A portion of the scale 8 has been removed in FIG. 1 to show an internal locking feature 10. Internal locking feature 10 comprises a split backspring with at least one biased member 12 for securing a blade 4 in at least one of an open and a closed position.

The biased member 12 generally comprises a distal end having an anvil 14 adapted to communicate with a tang portion 16 of the blade 4. The tang 16 receives the biased member 12 when the blade is rotated to a fully-open position such that the blade 4 is in a secured state. As used herein, locked or secured refers generally to a state wherein the blade requires a greater force or moment to move to rotate the blade out of the "secured" state than needed to place the blade in that state. In various preferred embodiments, "secured" or "locked" does not imply or require the use of an additional locking or release feature.

In a preferred embodiment, the anvil 14 provided on a distal end of the biased member 12 is received by a notch 18 provided in the tang 16 of the blade 4. As shown in FIG. 1, the anvil 14 is biased toward a position where it is engaged with the notch 18 and thus secures the blade in an open position without the need to activate release or latch mechanisms in order to return the blade to a closed position. In order to close the blade 4 shown in FIG. 1, a rotational force may be imparted upon the blade, the force being greater than a rotational force required to secure the blade in the open position.

Figure 2:
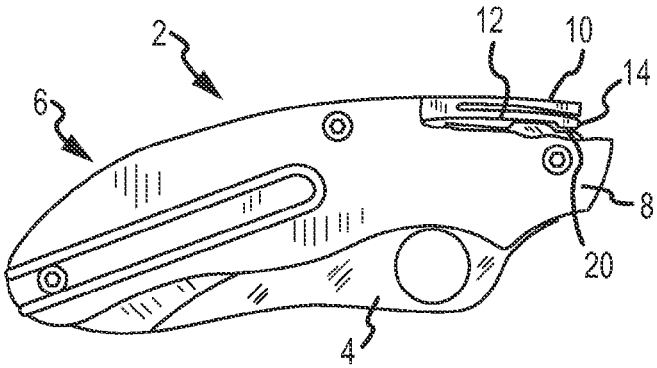
FIG. 2 is a front elevation view of a folding knife according to one embodiment of the present invention in a closed position.

FIG. 2 is a front elevation view of a folding knife 2 according to one embodiment provided in a closed position. A portion of a scale 8 is removed in FIG. 2 for illustration purposes in order to show a locking feature 10 according to one embodiment. The biased member 12 of the locking feature 10 communicates with the tang 16 of the blade 4 when the blade is in a closed position such that the blade 4 is biased toward the closed position. As further discussed herein, the tang 16 of the blade 4 is provided with a preferred geometry such that the anvil 14 communicates with the tang 16 and the blade is biased toward a closed position when the blade is disposed at angle of between approximately 0 and 30 degrees. The tang 16 is provided with a shelf portion 20 such that when the blade 4 is disposed in a closed position, the biased member 12 and anvil 14 will provide a resistance force to an opening motion, at least through a preliminary or initial rotation of the blade 4.

Figure 3:
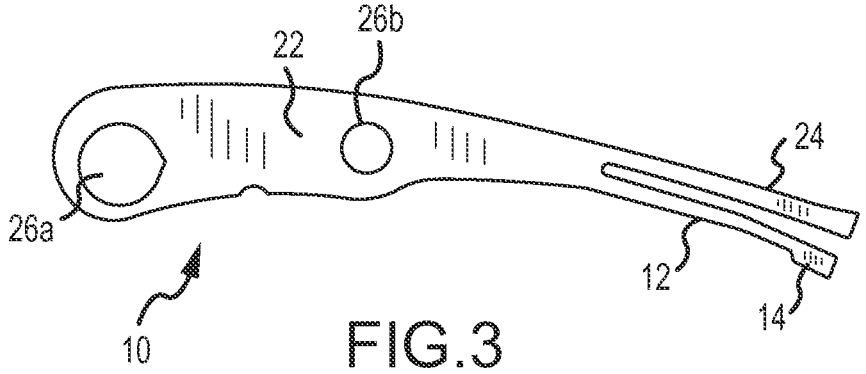
FIG. 3 is a front elevation view of a locking feature according to one embodiment of the present invention.

FIG. 3 is a front elevation view of a locking feature 10 according to one embodiment. As shown, the locking feature 10 comprises a main body portion 22 extending toward a bifurcated portion comprising a biased member 12 and a substantially rigid portion 24. A distal end of the biased member 12 comprises an anvil 14. One or more apertures 26*a*, 26*b* are provided in the locking feature 10 for securing the locking feature 10 to additional components. For example, in one embodiment, a locking feature is disposed between two scales of a knife handle, with at least one fastener provided through at least one aperture 26.

In alternative embodiments, a biased member is provided as an extension from the main body portion and the locking member is devoid of an upper rigid portion. For example, in one alternative embodiment, a locking member is provided having a main body portion that is substantially rigid. The main body portion is secured to a handle portion of a knife and the main body portion further comprises a tapered distal end, such that at least the end of the locking member proximal to the tang extends in a tapered manner and comprises a biased member. Thus, in various embodiments, a single biased protrusion extends from the main body portion as opposed to alternative embodiments wherein the biased member and the rigid portion extend from the main body portion and are at least partially separated by an elongate recess.

Figure 4:
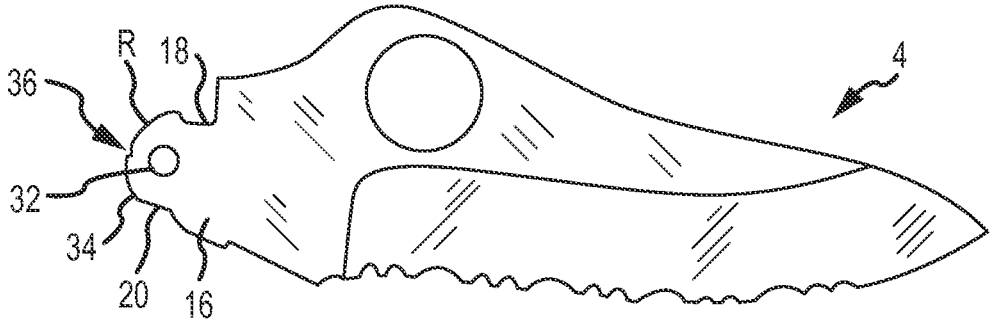
FIG. 4 is a front elevation view of a folding knife blade according to one embodiment of the present invention.

FIG. 4 is a front elevation view of a knife blade 4 adapted for use with a locking feature 10 according to various embodiments of the present invention. A blade 4 with a tang portion 16 is provided, the tang 16 comprising a notch 18, a radius of curvature R, a shelf portion 20, and a through hole 32 for rotatably mounting the knife with respect to a handle portion. The notch 18 provides for a point of engagement between an anvil of a locking member and assists in securing the blade in an open position. A radius R extends from one end of the notch 18 and enables rotation of the blade 4 even when contacted by the anvil of the locking member. In one embodiment, the radius R comprises a radius of between approximately 0.10 inches and 0.50 inches. In a preferred embodiment, the radius R comprises a radius of between approximately 0.15 inches and 0.25 inches. In a more preferred embodiment, the radius R comprises a radius of approximately 0.20 to 0.22 inches, particularly 0.2173 inches.

A shelf member 20 is provided adjacent the radius of curvature R and opposite the notch 18. The shelf member 20 communicates with the anvil of the locking member when the blade is in a substantially closed position and allows the anvil 14 and biased member 12 to bias the blade toward a completely closed position when the blade is disposed in a rotational position between zero and approximately 30 degrees, where zero degrees corresponds to a completely closed position. Accordingly, the intersection of the shelf member 20 and the radius R comprises a tipping point 34, wherein when the blade is rotated such that the anvil 14 comes into contact with the radius R and is no longer in contact with the shelf member 20.

In one embodiment, a secondary notch 36 is provided along the radius of curvature R. Secondary notch 36 provides feedback and/or physical indication of the partial rotation of the blade 4. In one embodiment, the secondary notch 36 is provided at approximately the mid-point of the radius R such that a user is alerted to the rotational position of the blade 4. In various embodiments, locking members 10 of the present invention are provided without secondary features such as back locks, liner locks, and various other known system for securing a blade of a folding knife as shown and described herein. As an additional safety measure, a secondary notch 36 is provided to indicate, such as through tactile feedback, that the blade is partially closed and/or provide temporary restraint of the blade in that position.

Figure 5:
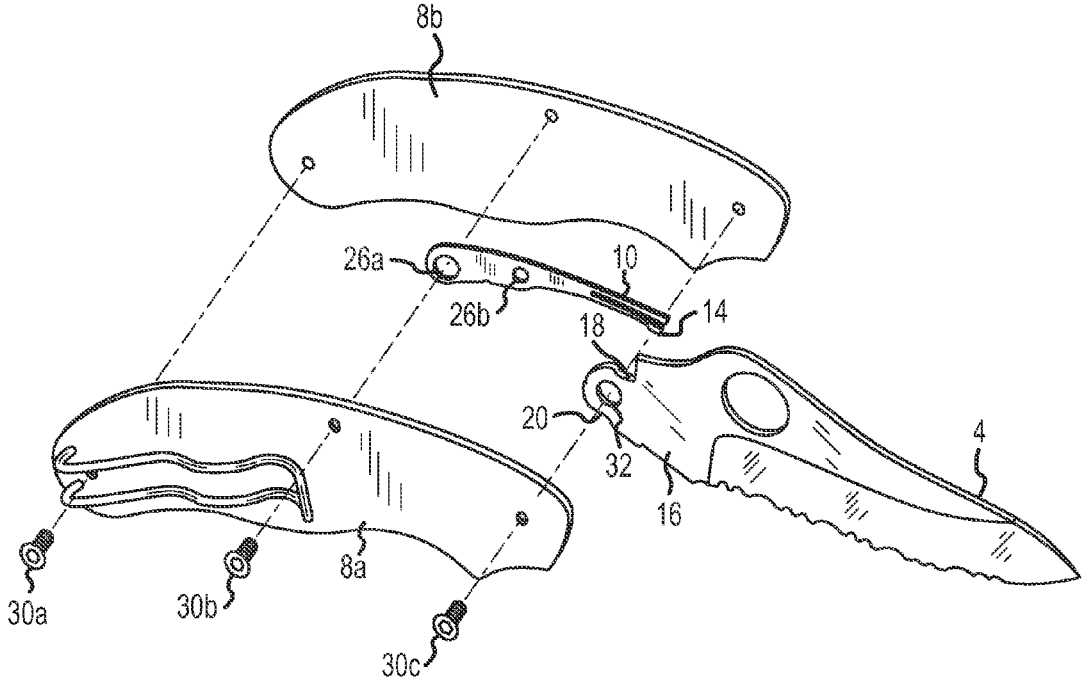
FIG. 5 is an exploded perspective view of a folding knife according to one embodiment of the present invention.

FIG. 5 is an exploded perspective view of a folding knife 2 according to one embodiment of the present invention. As shown, a knife blade 4 may be rotatably disposed between two scales 8*a*, 8*b* of a handle portion. The scales 8*a*, 8*b* and blade may be secured by one or more fasteners 30*a*, 30*b*, 30*c*, wherein at least one fastener is provided through a non-threaded through hole 32 provided in the tang 16 of the blade. Locking member 10 is disposed between scales 8*a*, 8*b* and secured by at least one fastener 30*b*. The locking member 10 is disposed proximal to the top edge of the handle portion and proximal to the tang portion 16 of the blade 4. While various embodiments of the present invention contemplate various features, such as the locking member 10 and scales 8*a*, 8*b* being secured to each other and/or various additional features of the present invention, it will be expressly recognized that the present invention is not limited to any particular system or means for securing elements. Indeed, it is contemplated that various members and portions of various members may be assembled and/or secured through various means and devices, including adhesives, welding, ultrasonic welding, and various other devices and systems as will be recognized by one of skill in the art.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A folding knife comprising:

an implement having an upper edge, a lower edge, a tang and a distal end;

a handle portion comprising a first scale and a second scale, said first scale and said second scale having a forward end, a rear end, an upper end and a lower end;

said tang of said implement rotatably interconnected to said handle portion, said tang comprising a notch and a shelf portion with a radius of curvature extending between the notch and the shelf portion to enable rotation of the implement;

a locking member provided between said first scale and said second scale, said locking member comprising a body portion, said body portion having at least one aperture for securing to at least one of said first and second scales preventing said body portion from rotation, said body portion further comprising an upper arm and a deflectable lower arm extending from said body portion linearly relative to one another, and separated by a predetermined distance, said upper arm and said lower deflectable arm extending less than half a length of said body portion, wherein said body portion, said upper arm and said deflectable lower arm comprise a monolithic locking member, and wherein the deflectable lower arm is in contact with said tang to provide a biasing force on said tang at all rotational positions of said implement;

wherein said upper arm comprises a rigid portion of the locking member, and wherein said upper arm is fixed relative to the handle portion;

said deflectable lower arm being biased toward said lower end of said handle portion and wherein said lower arm is deflectable toward said upper arm and said body portion remains secured against rotation when said implement is rotated with respect to said handle portion;

said notch adapted to engage the locking member and secure the implement in an open position;

said shelf portion adapted to engage the locking member and secure the implement in a closed position;

wherein a point is provided at an intersection of the shelf portion and the radius of curvature and wherein the implement is biased toward a closed position when the locking member is provided at a position at or between the shelf portion and the point; and wherein said deflectable lower arm is deflectable in a first direction and bound by said first and second scales in a second direction, said second direction being perpendicular to said first direction;

wherein distal ends of said upper arm and said lower arm are positioned proximate to each other and abut a back end portion of the tang provided vertically relative to said notch forming a generally L shape with said notch when the folding knife is provided in the open position;

wherein said upper arm comprises a fixed stop position and limits rotation of the implement at least when the implement is provided in the open position; and wherein an entirety of the locking member is disposed between the first scale and the second scale and no portion of said locking member extends outside a perimeter of said first and second scales in said implement open position, closed position, and all rotational positions between said open and closed positions.

2. The folding tool of claim 1, wherein said rigid portion is secured to said first scale and said second scale.

3. The folding tool of claim 1, wherein said notch portion is adapted to receive at least a portion of said deflectable lower arm such that a closing action of said implement requires a greater force than an opening action.

4. The folding tool of claim 1, wherein said biased portion biases said implement toward a closed position at least when said implement is disposed between approximately zero degrees of rotation of approximately 30 degrees of rotation from said closed position.

5. The folding tool of claim 1, wherein a distal end of said lower arm comprises an anvil for communicating with said tang portion.

6. The folding tool of claim 1, wherein said implement comprises a knife blade.

7. A folding knife comprising:

a handle portion comprising a first scale and a second scale;

a blade rotatable relative to said handle portion, said blade comprising a tang with a shelf portion and a radius of curvature, and a point provided at an intersection of the shelf portion and the radius of curvature;

a monolithic locking member comprising a main body portion having a first end and a second end defining length, and a width, said length being greater than said width, and wherein an entirety of the monolithic locking member is disposed between the first scale and the second scale and no portion of said locking member extends outside a perimeter of said first and second scales in a blade open position, a blade closed position, and all rotational positions between said open and closed positions;

said first end of said main body portion comprising at least one aperture affixed to at least one of the first and second scales securing said main body against rotation;

said second end of said main body portion comprising an elongate recess provided between an upper portion and a lower portion, said lower portion comprising a biased member and said upper portion comprising a rigid portion extending from the main body portion and wherein said upper portion is fixed relative to the main body portion and the handle portion and adapted to limit a rotation of said blade by contacting a portion of said tang, said upper portion and said lower portion extending less than half a length of said body portion;

said biased member provided between said first scale and said second scale and deflectable in a first direction coplanar with said upper portion, and wherein said biased member is fixed in a direction which is perpendicular to a longitudinal axis of said folding knife, and wherein said biased member is biased away from said upper portion;

said biased portion in contact with said tang to provide a biasing force on a blade of said folding knife, wherein the blade is biased toward a closed position when the biased member provides a force at or between said shelf portion and the point; and wherein a distal end of said upper portion and a distal end of said lower portion are positioned proximate to each other and adjacent to a common surface of a rear portion of the tang when the folding knife is provided in an open position; and wherein the blade is operable to be closed by imparting a rotational force on the blade.

8. The locking member of claim 7, wherein said biased member comprises a distal end having a protrusion for communicating with a tang of a blade of a folding knife.

9. The folding knife of claim 7, wherein said biased member comprises a leaf spring.

10. The folding knife of claim 7, wherein said tang comprises a notch portion, said notch portion receiving at least a portion of said biased member such that a closing action of said blade requires a greater force than an opening action.

11. The folding knife of claim 7, wherein said biased portion biases a blade portion of said knife toward a closed position at least when said blade is disposed between approximately zero degrees of rotation of approximately 30 degrees of rotation from said closed position.

12. The folding knife of claim 7, wherein said radius of curvature communicates with said biased member throughout rotation of said blade.

13. The folding knife of claim 7, wherein said locking member is secured between a first scale and second scale by at least one fastener and said locking member comprises a length less than a length of said scale portions.

14. The folding knife of claim 7, wherein said biasing force impedes at least one of an opening and a closing of said blade.

15. A folding knife comprising:

a blade having an upper edge, a lower edge, a tang and a distal end;

said tang comprising a shelf portion and a radius of curvature, and a point provided at an intersection of the shelf portion and the radius of curvature;

a handle portion comprising a first scale and a second scale, said first scale and said second scale comprising a forward end, a rear end, an upper end and a lower end;

said first scale and said second scale spaced apart by a predetermined width;

said tang of said blade rotatably interconnected to said handle portion;

a monolithic locking member entirely disposed between respective interior surfaces of said first scale and said second scale and no portion of said monolithic locking member extends outside a perimeter of said first and second scales in a knife open position, a knife closed position, and all rotational positions between said open and closed positions, said monolithic locking member comprising a body portion, the body portion comprising an upper arm and a deflectable lower arm extending therefrom, the upper arm and deflectable lower arm separated by a predetermined distance, and said upper arm and said lower deflectable arm extending less than half a length of the body portion;

wherein the lower arm of the monolithic locking member is in contact with said tang to provide a biasing force on said blade and secure the blade in at least one of an open and a closed position;

wherein said body portion said upper arm comprises rigid portions fixed relative to the handle portion, said body portion further comprises at least one aperture securing said body portion to said handle against rotation, and the upper arm adapted to limit a rotation of said blade by contacting a portion of said tang;

wherein said lower arm is deflectable in a first direction and restrained from travelling in a second direction, said second direction comprising a lateral direction toward or away from the first scale;

wherein distal ends of said upper arm and said lower arm are positioned proximate to each other and proximal to the portion of the tang when the folding tool is provided in the open position; and wherein the knife is transitioned from said open position to said closed position by applying a rotational force upon said knife and/or handle portion.

* * * * *